United States Patent [19]

Sato et al.

[11] Patent Number: 4,541,396

[45] Date of Patent: Sep. 17, 1985

[54] SUPERCHARGED INTERNAL COMBUSTION ENGINE

[75] Inventors: Kenichi Sato, Ebina; Yoshitaka Ohki, Yokohama, both of Japan

[73] Assignee: Nissan Motor Co., Ltd., Yokohama, Japan

[21] Appl. No.: 573,204

[22] Filed: Jan. 23, 1984

[30] Foreign Application Priority Data

Jan. 25, 1983 [JP] Japan ..... 58-10146

[51] Int. Cl.[4] ..... F02M 39/00

[52] U.S. Cl. ..... 123/518; 123/520; 123/383

[58] Field of Search ..... 123/518, 519, 520, 521, 123/383, 528, 516

[56] References Cited

U.S. PATENT DOCUMENTS

| | | | |
|---|---|---|---|
| 4,059,081 | 11/1977 | Kayanuma | 123/521 |
| 4,193,383 | 3/1980 | Rogers | 123/520 |
| 4,446,940 | 5/1984 | Sakakibara | 123/383 |

FOREIGN PATENT DOCUMENTS

| | | | |
|---|---|---|---|
| 52-40216 | 3/1977 | Japan | 123/520 |
| 57-143155 | 9/1982 | Japan | 123/520 |
| 57-195847 | 12/1982 | Japan | 123/519 |
| 58-110853 | 7/1983 | Japan | 123/519 |
| 2035451 | 6/1980 | United Kingdom | 123/520 |

*Primary Examiner*—Carl Stuart Miller

*Attorney, Agent, or Firm*—Schwartz, Jeffery, Schwaab, Mack, Blumenthal & Evans

[57] ABSTRACT

A control system for evaporated fuel in a supercharged internal combustion engine having a canister including a reservoir for temporarily accommodating evaporated fuel by adsorption, an intake manifold downstream from a throttle valve and an intake duct upstream from the throttle valve, the intake manifold being communicated with the canister through a first evaporated fuel supply passage having a first purge control valve and the intake duct being communicated with the canister through a second evaporated fuel supply passage having a second purge control valve, wherein the second purge control valve is opened to urge the canister in communication with the intake duct through the second evaporated fuel supply passage when the negative pressure within the intake duct has reached a predetermined value or more.

6 Claims, 4 Drawing Figures

SUPERCHARGED INTERNAL COMBUSTION ENGINE

BACKGROUND OF THE INVENTION

This invention relates to a control system for evaporated fuel in a supercharged internal combustion engine, and more particularly to an improvement of evaporated fuel supply passages between a fuel reservoir and an air intake means.

In Published Japanese patent application No. 57-143155, there is disclosed an internal combustion engine having an electronic fuel injection system, which includes an example of the prior art control system for evaporated fuel as illustrated in FIGS. 1(A) and 1(B).

The prior art control system for evaporated fuel in FIG. 1(A) comprises an air intake passage means including an air cleaner 1 to introduce air, an air flow meter 2 to meter the flow rate of the air passing therethrough, a supercharging impeller 3 which is accomodated in a supercharger housing 4 and rotated by an exhaust gas impeller (not shown) driven by exhaust pressure, a throttle valve 5 housed in a throttle chamber 6 to receive the air pressurized by the supercharging impeller 3 and an intake manifold 7 to pass the air to each combustion chamber of an engine main portion 8.

The prior art control system further comprises an evaporated fuel supply passage means including a fuel tank 9 having an air chamber 10 and a canister 11 filled with adsorbent such as activated carbon for a reservoir 12, wherein the fuel tank 9 is communicated with the canister 11 through a passage 14 having a check valve 13 therein. The canister 11 is adapted to accomodate temporarily through adsorption the evaporated fuel produced in and sent from the fuel tank 9, for example after the stop of the engine operation.

The canister 11 comprising the reservoir 12 is communicated with the intake manifold 7 at a portion downstream of the throttle valve 5 through a first evaporated fuel supply passage 15.

Disposed at the end of the first evaporated fuel supply passage 15 above the reservoir 12 is a first purge control valve 16 to open and close controllably the first evaporated fuel passage 15. The first purge control valve 16 may be of the type operational in a manner to be open during the throttling operation wherein a vacuum or negative pressure is created around or downstream of the throttle valve 5 in the air intake passage means.

The structure and operation of the first purge control valve 16 is set forth in detail hereinafter referring to FIG. 1(B).

The first purge control valve 16 comprises an upper extension of the canister 11 partially defining a plenum 16A, a diaphragm 16B defining the plenum 16A together with the upper extension of the canister 11 and separating the plenum 16A from the reservoir 12 and a valve body 16C integrally connected to the central portion of the diaphragm 16B and being positioned adjacent the opening 15A with an orifice of the first evaporated fuel supply passage 15.

The plenum 16A is communicated with the throttle chamber 6 through a passage 17 and supplied with a vacuum or negative pressure (VC negative pressure) around the throttle valve 5. Accordingly, the first purge control valve 16 is operated in correspondence with the vacuum or negative pressure around the throttle valve 5 such that the diaphragm 16B moves upwards with reference to the drawing when the plenum 16A is exposed to a higher vacuum during the lower and medium load ranges or throttling operation of the engine. The upward movement of the diaphragm 16B causes the valve body 16C integrally connected to the diaphragm 16B to open an opening or orifice 15A of the first evaporated fuel supply passage 15 so that the passage 15 is communicated with the reservoir 12.

Additionaly connected to the canister 11 above the reservoir 12 is a second evaporated fuel supply passage 19 which communicates the interior of the canister 11 comprising the reservoir 12 with an intake passage or duct 18 upstream of the supercharging impeller 3, in other words between the air flow meter 2 and the supercharging impeller 3. The air flow meter 2 and other members upstream from the supercharging impeller 3 provide air-flow resistance which produces a negative pressure in the intake duct 18. The second evaporated fuel supply passage 19 at the end thereof adjacent the canister 11 is provided with an orifice 20 of a predetermined diameter.

Formed on the lower side of the canister 11 is an opening 21*a* for drawing the ambient air, and a filter or air cleaner 21*b* is provided adjacent the opening 21*a*.

In operation, when the throttle valve 5 is controlled during the lower or medium load range of the prior art engine so that a vacuum or negative pressure prevails around the throttle valve 5 in the air intake passage means, the first purge control valve 16 is opened so that the first evaporated fuel supply passage 15 provides flow communication between the canister 11 and the intake manifold 7 as mentioned above.

Accordingly, the vacuum or negative pressure in the manifold 7 downstream of the intake valve 5 is applied to the canister 11 comprising the reservior 12 through the first evaporated fuel supply passage 15. The vacuum or negative pressure applied to the canister 11 through the first evaporated fuel supply passage 15 causes the evaporated fuel absorbed in the reservoir 12 in the canister 11 to go out of the reservoir 12 together with air which has passed through the filter 21*b*. The mixture of the evaporated fuel and air is introduced into the intake manifold 7 through the first evaporated fuel supply passage 15 and then into each combustion chamber of the engine main portion 8 for combustion process. The evaporated fuel is thus purged from the reservoir 12 in the canister 11.

The canister 11 is communicated not only with the intake manifold 7 but also with the intake duct 18 between the supercharging impeller 3 and the air flow meter 2 through the second evaporated fuel supply passage 19 as mentioned above. Since the second evaporated fuel supply passage 19 is always open, the negative pressure in the intake duct 18 is always applied to the reservoir 12 in the canister 11. However, the flow rate of air during the low or medium load operation is small, and therefore the vacuum or negative pressure in the intake duct 18 is low or weak, so that only a limited amount of the evaporated fuel is purged through the second evaporated fuel supply passage 19. Consequently, it should be noted that almost all of the evaporated fuel is purged through the first evaporated fuel supply passage 15.

On the other hand, when the throttle valve 5 is controlled so as to be substantially in a fully opened condition during the high load range of the prior art engine, the supercharging impeller 3 pressurizes the intake manifold 7, so that the pressure in the intake manifold 7 and the throttle chamber 6 becomes so positive as to force the valve body 16C of the first purge control valve 16 against the end of the first evaporated fuel supply passage 15, thereby closing the first purge control valve 16. Therefore, the evaporated gas is prevented from flowing through the first evaporated fuel supply passage 15.

Consequently, it will be noted that only the negative pressure from the intake duct 18 is applied to the reservoir 12 in the canister 11 through the second evaporated fuel supply passage 19. Accordingly, the evaporated fuel adsorbed in the reservoir 12 is drawn into the intake duct 18 through the second evaporated fuel supply passage 19, urged to flow into the intake manifold 7 by the supercharging impeller 3 and then supplied to each combustion chamber of the engine main portion 8 for the combustion process as mentioned previously. In this case, it should be noted that the amount of air flow during the high load operation is so large that an increased amount of the evaporated fuel is purged through the second evaporated fuel supply passage 19.

From the foregoing description, it will be understood that the evaporated fuel of the prior art engine undergoes the combustion process in correspondence with the operation condition of the engine.

However, since the second evaporated fuel supply passage 19 is always open in such a control system for evaporated fuel of the prior art supercharged internal combustion engine, part of the evaporated fuel may be purged to the intake duct 18 through the second evaporated fuel supply passage 19 even when the engine is stopped. This causes a problem that the evaporated fuel purged as mentioned above flows reversely through the air flow meter 2 and the filter 1 and exhausted to the atmosphere. Also, in the operation of such a prior art supercharged internal combustion engine in which the air flow meter 2 is of the hot-wire type, for instance when the throttle valve 5 is suddenly closed, intake pulsations occur in the intake duct 18 because the evaporated fuel is always purged into the intake duct 18. Such intake pulsations would cause the evaporated fuel purged to the intake duct 18 to flow reversely to the air flow meter 2 of the hot-wire type and come into contact with a hot-wire in a heat-generating condition. This would cause the evaporated fuel to burn, thereby burning out the hot-wire.

Accordingly, a primary object by the present invention is to provide a control system for evaporated fuel which prevents securely the evaporated fuel from being exhausted to the atmosphere reversely through the air intake passage in a supercharged internal combustion engine.

Another object of the present invention is to provide a control system for evaporated fuel in a supercharged internal combustion engine which prevents securely the evaporated fuel from being purged from the reservoir therefor when the engine is stopped.

Another object of the present invention is to provide a control system for evaporated fuel which can be applied without failure to a supercharged internal combustion engine having an air flow meter of the hot-wire type.

SUMMARY OF THE INVENTION

The present invention, in accordance with one embodiment thereof, provides a control system for evaporated fuel in a supercharged internal combustion engine, wherein a reservoir for adsorbing evaporated fuel is controllably communicated with an intake passage upstream of a supercharging impeller for drawing air. A purge control valve may be used to urge the reservoir in flow communication with the intake passage when the vacuum or negative pressure within the intake duct has reached a predetermined value or more.

BRIEF DESCRIPTION OF THE DRAWING

The invention will be better understood from the following description taken in conjunction with the accompanying drawing, wherein.

DESCRIPTION OF THE PREFERRED EMBODIMENT

Figure 2A:
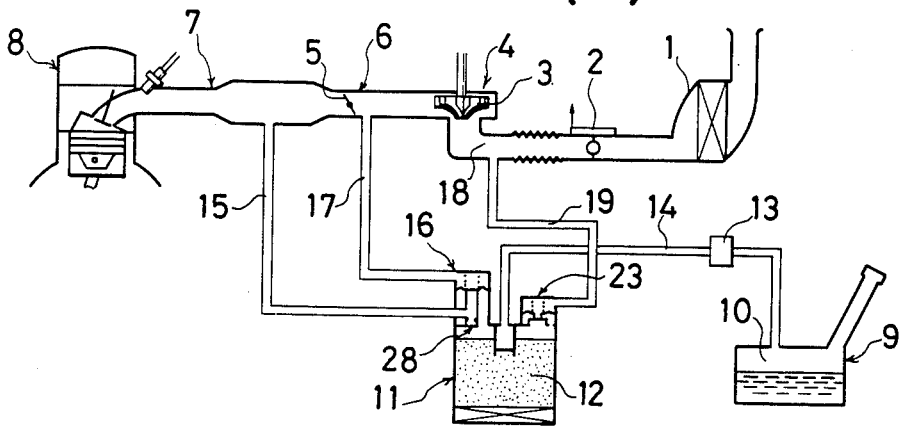
FIG. 2(A) is a schematic illustration of one embodiment of the control system for evaporated fuel according to the present invention including a reservoir contained within a canister.

Turning now to a consideration of the drawing, wherein like reference numerals designate previously described members, the control system for evaporated fuel in a supercharged internal combustion engine shown in FIG. 2(A) comprises an air intake passage means comprising in serial flow relation a filter or air cleaner 1, an air flow meter 2, a supercharging impeller 3 accomodated in a supercharging housing 4, a throttle valve 5 housed in a throttle chamber 6 and an intake manifold 7 connected to an engine main portion 8, and a fuel supply passage means comprising in serial flow relation a fuel tank 9 having an air chamber 10 and a reservoir 12 accomodated in a canister 11. The fuel tank 9 is communicated with the reservoir 12 in the canister 11 through a passage 14. The reservoir 12 is further communicated with the intake manifold 7 downstream from the throttle valve 5 through a first evaporated fuel supply passage 15, and with an intake duct or passage 18 downstream from the air flow meter 2 and upstream from the supercharging impeller 3 through a second evaporated fuel supply passage 19.

The first evaporated fuel supply passage 15 is formed with a first purge control valve 16 comprising an upper extension of the canister 11 partially defining a plenum 16A, a diaphragm 16B defining the plenum 16A together with the upper extension of the canister 11 and separating the plenum 16A from the reservoir 12 and a valve body 16C integrally connected to the central portion of the diaphragm 16B and being positioned adjacent the opening 15A of the first evaporated fuel supply passage 15. The first purge control valve further has a spring means which biases the diaphragm 16B and the valve body 16C downwardly against the opening 15A, and a spring guide within the spring means which also functions as a valve stopper against the upward movement of the valve body 16C.

The first purge control valve 16 is controlled by the pressure within the throttle chamber 6 around the throttle valve 5 which is transmitted through a passage 17. The passage 17 has an opening near the throttle valve 5 such that the throttle valve 5 when closed during idling is located downstream from the opening of the passage 17, and as it is opened, it is relatively shifted to the upstream side of the opening.

The structure and function of these control means are substantially the same as those described with reference to the prior art control system shown in FIGS. 1(A) and 1(B). Therefore, detailed description is omitted.

According to one feature of the embodiment shown in FIG. 2(A), a second purge control valve 23 is arranged in the second evaporated fuel supply passage 19. The second purge control valve 23 is adapted to be open when the vacuum or negative pressure in the intake duct 18 upstream of the supercharging impeller 3 has reached a predetermined value or more, whereby the flow communication through the second evaporated fuel supply passage 19 is allowed between the intake duct 18 and the reservoir 12.

Figure 1A:
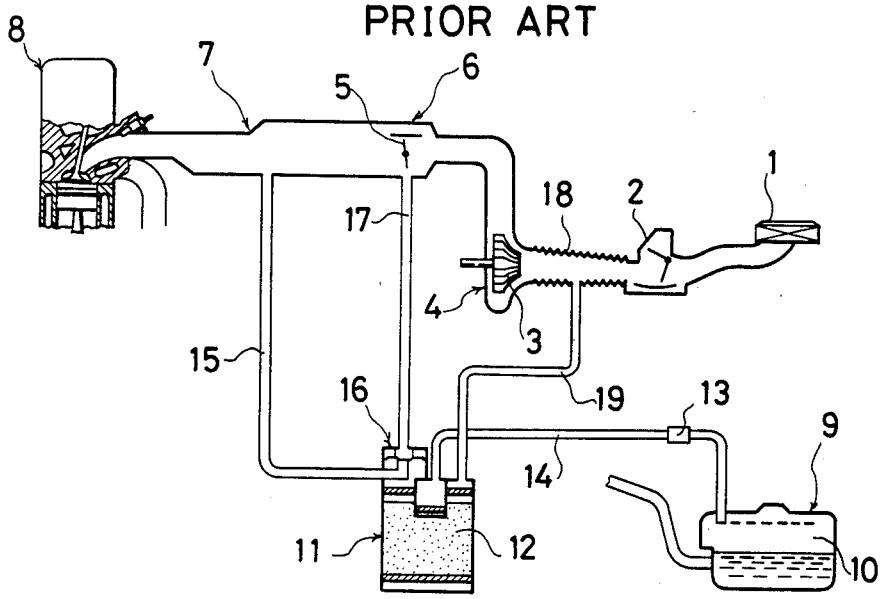
FIG. 1(a) PRIOR ART
FIG. 1(A) is a schematic illustration of one example of the prior art control system for evaporated fuel incorporated in an internal combustion engine.
Figure 1B:
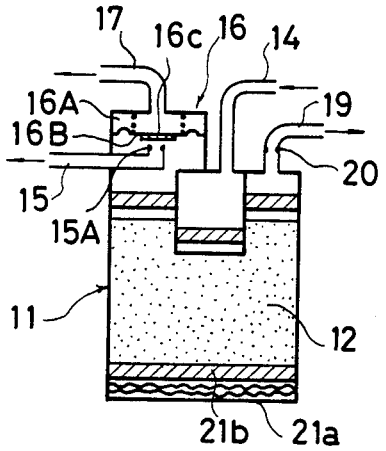
FIG. 1(b) PRIOR ART
FIG. 1(B) is a schematic illustration of a canister comprising a reservoir for adsorbing the evaporated fuel and used in the control system of FIG. 1(A).

The second purge control valve 23 is comprised of a diaphragm valve and integrally mounted on the upper portion of the main housing 11A of the canister 11 in a similar manner that the first purge control valve 16 in the prior art control system as shown in FIG. 1(B) is provided in the first evaporated fuel supply passage 15 through which the reservoir 12 within the canister 11 is communicated with the intake manifold 7 downstream of the throttle valve 5.

Figure 2B:
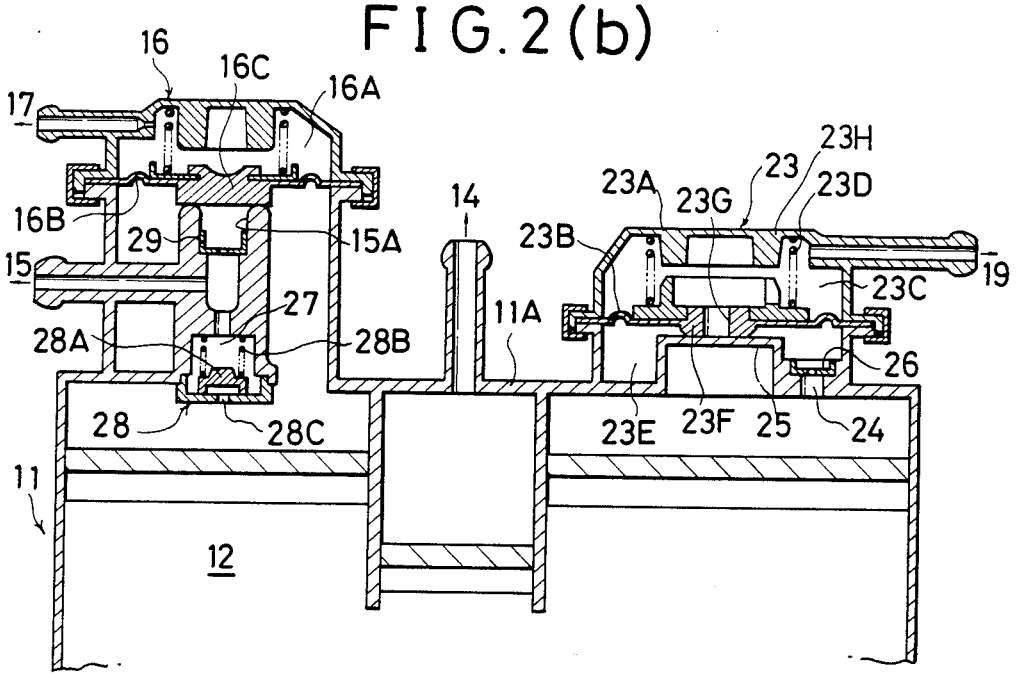
FIG. 2(B) is a schematic illustration showing the upper portion of the reservoir of FIG. 2(A).

The second purge control valve 23 illustrated in detail in FIG. 2(B) comprises a valve housing 23A, a diaphragm 23B oscillatably supported by the valve housing 23A and the main housing 11A of the canister 11, an upper diaphragm chamber (plenum) 23C defined by the upper surface of the diaphragm 23B and the valve housing 23A, a diaphragm spring 23D disposed in the upper diaphragm chamber 23C for biasing the diaphragm 23B, a lower diaphragm chamber 23E defined by the lower surface of the diaphragm 23B and the main housing 11A of the canister 11, a valve body 23F integrally formed substantially at the center portion of the diaphragm 23B and having a valve opening 23G therein, and a valve seat 25 projecting from the main housing 11A in a manner to mate sealingly with the valve body 23F biased by the diaphragm spring 23D.

The upper diaphragm chamber 23C is communicated with the intake duct 18 through the second evaporated fuel supply passage 19, whereas the lower diaphragm chamber 23E is communicated with the reservoir 12 in the canister 11 through a through-hole 24 formed in the main housing 11A and having an orifice 26 of a relatively large diameter (e.g. about 2 mm).

The valve body 23F is adapted to engage with and disengage from the valve seat 25 in correspondence with the movement of the diaphragm 23B as described hereinafter. The upward movement of the valve body 23F is limited by a spring guide 23H disposed in the diaphragm spring 23D. Thus, the spring guide 23H functions as a valve stopper.

When the vacuum or negative pressure applied to the upper diaphragm chamber 23C through the second evaporated fuel supply passage 19 from the intake duct 18 has reached a predetermined value or more, the diaphragm 23B moves upwards with reference to the drawing, so that the valve body 23F of the diaphragm 23B disengages from the valve seat 25. Consequently, the upper and lower diaphragm chambers 23C, 23E are communicated with each other through the valve opening 23G of the valve body 23F.

According to another feature of the embodiment illustrated in FIG. 2(A), the first purge control valve 16 cooperates with a one-way valve which includes a bypass passage 27 which is branched off at the end portion of the first evaporated fuel supply passage 15 within the main housing 11A for bypassing the valve opening 15A and the valve body 16C to put the reservoir 12 in the canister 11 in controllable flow communication with the first evaporated fuel supply passage 15. In other words, the end portion of the first evaporated fuel supply passage 15 has two opposite openings one for the first purge control valve 16 and the other for the one-way valve 28.

The bypass passage 27 is integrally connected to and supported by the main housing 11A, and the one-way valve 28 is formed on the side of the bypass passage 27 remote from the valve opening 15A.

The one-way valve 28 comprises a valve body 28A, a valve spring 28B and a valve opening or orifice 28C having a predetermined diameter (e.g. about 0.21 mm).

The bypass passage 27 is adapted to be communicated with the reservoir 12 when the vacuum or negative pressure for intake downstream of the throttle valve 5, for instance, during engine idling becomes so high as to cause the valve body 28A to move upwardly with reference to the drawing against the biasing force of the valve spring 28B, thereby opening the valve opening 28C.

The other members of the embodiment shown in FIG. 2(A) are substantially the same as those in FIGS. 1(A) and 1(B), for example, an orifice 29 having a predetermined diameter (e.g. about 1.5 mm) is fitted in the valve opening 15A of the first purge control valve 16. Accordingly, the description about these members is omitted. It should be noted, however, that the air flow meter 2 is of the hot-wire type in the embodiment of FIG. 2(A).

According to the structure of the present invention, when the engine is stopped, not only the pressure near and downstream from the throttle valve 5 of the intake manifold 7 but also the pressure within the intake duct 8 upstream from the supercharging impeller 3 are atmospheric, so that all of the first purge control valve 16, the second purge control valve 32 and the one-way valve 28 are closed.

Consequently, both of the first evaporated fuel supply passage 15 and the second evaporated fuel supply passage 19 are closed, so that no evaporated fuel is purged from the canister 11 through the first evaporated fuel supply passage 15 to the intake manifold 7, and through the second evaporated fuel supply passage 19 to the intake duct 18. Accordingly, the present invention has overcome the problem in the prior art supercharged internal combustion engine that when the engine is stopped, part of the evaporated fuel purged from the reservoir 12 is urged to flow reversely to the air cleaner 1 and then exhausted to the atmosphere.

During a first operation mode wherein the engine is idling with the throttle valve 5 being closed, the pressure around the throttle valve 5 is slightly negative but the negative pressure in the intake manifold 7 is increased, so that the one-way valve 28 is opened with the first purge control valve 16 being still closed. The second purge control valve 23 is also closed because the pressure within the intake duct 18 upstream of the supercharging impeller 3 is still slightly negative.

Accordingly, the first evaporated fuel supply passage 15 is communicated with the canister 11 through the bypass passage 27, while the second evaporated fuel supply passage 19 and the valve opening 15A are closed, whereby the maximum flow rate of the evaporated fuel through the first evaporated fuel supply passage 15 is controlled by the valve opening 28C having a predetermined diameter in the bypass passage 27 during the purging of the evaporated fuel into the intake manifold 7 in this operation mode. In other words, a small amount of the evaporated fuel is purged into the intake manifold 7, from which each combustion chamber of the engine main portion 8 is supplied with the evaporated fuel for combustion process.

During a second operation mode wherein the engine is throttled in the low or medium load range of operation excluding the idling, the negative pressure downstream from and around the throttle valve 5 is so large that not only the one-way valve 28 but also the purge control valve 16 are opened, whereas the second purge control valve 23 is still closed because the pressure within the intake duct 18 upstream of the supercharging impeller 3 is kept slightly negative.

Consequently, in the second operation mode mentioned above, the first evaporated fuel supply passage 15 is communicated with the reservoir 12 with the second evaporated fuel supply passage 19 being closed as during the first operation mode. In the second operation mode, however, the first evaporated fuel supply passage 15 is communicated with the canister 11 through the larger valve opening 15A having the orifice 29, so that the amount of the evaporated fuel purged through the first evaporated fuel supply passage 15 is increased, whereby the evaporated fuel is effectively burned in the stable operation range.

Finally, in a third operation mode wherein the engine is supercharged in the high load range of operation with the throttle valve 5 almost fully opened, the pressure within the intake manifold 7 and the throttle chamber 6 is positive due to the supercharging effects of the supercharging impeller 3, so that both of the first purge control valve 16 and the one-way valve 28 are closed, while the second purge control valve 23 is open due to the increased negative pressure caused by the increased intake flow rate within the intake duct 18 upstream of the supercharging impeller 3.

Consequently, only the second evaporated fuel supply passage 19 is communicated with the canister 11 in the third operation mode, wherein the evaporated fuel within the canister 11 is drawn under the vacuum or negative pressure and purged into the intake duct 18 successively through the through-hole 24, the lower diaphragm chamber 23E, the valve opening 23G, the upper diaphragm chamber 23C and the second evaporated fuel supply passage 19 connected to the chamber 23C. The evaporated fuel is then urged by the supercharging impeller 3 to flow into the intake manifold 7, from which each combustion chamber of the engine main portion 8 is supplied with the evaporated fuel for combustion process as mentioned previously.

From the foregoing description, it will be noted that the purging of evaporated fuel through the intake duct 18 upstream of the supercharging impeller 3 conducted only during the supercharge operation of engine has securely overcome the afore-mentioned problem in the prior art engine having the second evaporated fuel passage always opened.

While preferred embodiments of this invention have been shown and described, it will be appreciated that other embodiments will become apparent to those skilled in the art upon reading this disclosure, and, therefore, the invention is not to be limited by the disclosed embodiments.

What is claimed is:

1. A supercharged internal combustion engine comprising:

an air intake passage means comprising in serial flow relation an air cleaner, an air flow meter, a supercharging impeller, a throttle valve and an intake manifold connected to an engine main portion, a fuel supply passage means comprising in serial flow relation a fuel tank and a canister including a reservoir for accommodating evaporated fuel, a first evaporated fuel supply passage for communicating said canister with said intake manifold downstream from said throttle valve, a first purge control valve means for controlling said first evaporated fuel supply passage, a second evaporated fuel supply passage for communicating said canister with said intake passage upstream from said supercharging impeller, a second purge control valve means for controlling said second evaporated fuel supply passage, wherein said second purge control valve means is opened to urge said canister in communication with said intake passage upstream from said supercharging impeller through said second evaporated fuel supply passage when the negative pressure within said intake passage has reached a predetermined value or more, a one-way valve provided to cooperate with said first purge control valve, wherein said first purge control valve is operated in correspondence with the negative pressure around said throttle valve, wherein said one-way valve is operated in correspondence with the negative pressure within said intake manifold downstream from said throttle valve, and wherein said first purge control valve is adapted to open and close one of two openings at the end portion of said first evaporated fuel supply passage while said one-way valve is adapted to open and close the other of said two openings.

2. The supercharged internal combustion engine of claim 1, wherein said second purge control valve means comprises an upper diaphragm chamber communicated with said intake passage through said second evaporated fuel supply passage, a lower diaphragm chamber separated from said upper diaphragm chamber by a diaphragm and communicated with said canister, a spring means disposed in said upper diaphragm chamber for biasing said diaphragm, a valve body integrally mounted to said diaphragm and having a valve opening, and a valve seat adapted to mate sealingly with said valve body biased by said diaphragm spring, whereby said valve body is adapted to disengage from said valve seat when the negative pressure within said intake passage has reached a predetermined value or more to provide said intake passage in communication with said canister.

3. The supercharged internal combustion engine of claim 1, wherein all of said first and second purge control valves and said one-way valve are closed when the engine is stopped, whereby no evaporated fuel is purged through said first and second evaporated fuel supply passages.

4. The supercharged internal combustion engine of claim 1, wherein when the engine is idling, said one-way valve is open while said first and second purge control valves are closed, whereby a small amount of evaporated fuel is supplied to said intake manifold.

5. The supercharged internal combustion engine of claim 1, wherein when the engine is operated in the lower and medium load ranges excluding idling, said one-way valve and said first purge control valve are open while said second purge control valve is closed, wherein a larger amount of evaporated fuel is supplied to said intake manifold.

6. The supercharged internal combustion engine of claim 1, wherein when the engine is operated in the supercharged, high load range, both of said first purge control valve and said one-way valve are closed while said second purge control valve is open, whereby evaporated fuel is supplied to said intake manifold through said supercharging impeller.

* * * * *